US006276685B1

(12) United States Patent
Sterling

(10) Patent No.: US 6,276,685 B1
(45) Date of Patent: Aug. 21, 2001

(54) THREE DIMENSIONAL BOARD GAME

(76) Inventor: John B. Sterling, 2427 Hartfell Rd., Timonium, MD (US) 21093

( * ) Notice: Subject to any disclaimer, the term of this patent is extended or adjusted under 35 U.S.C. 154(b) by 0 days.

(21) Appl. No.: 09/611,630

(22) Filed: Jul. 7, 2000

(51) Int. Cl.[7] ..... A63F 3/00

(52) U.S. Cl. ..... 273/241; 273/236; 273/261; 273/249

(58) Field of Search ..... 273/236, 241, 273/242, 243

(56) References Cited

U.S. PATENT DOCUMENTS

| | | | |
|---|---|---|---|
| D. 234,366 | 2/1975 | Zelenko . | |
| D. 370,027 | 5/1996 | Wood . | |
| D. 370,235 | 5/1996 | Wood . | |
| D. 387,390 | 12/1997 | Seiler . | |
| D. 420,057 | 2/2000 | Colombo . | |
| 2,953,379 | 9/1960 | Preston . | |
| 3,684,285 | 8/1972 | Kane . | |
| 4,082,283 | 4/1978 | La Ferla et al. . | |
| 4,099,723 | 7/1978 | Robinson . | |
| 4,203,344 | 5/1980 | Krosnick . | |
| 4,280,809 | 7/1981 | Greenberg et al. . | |
| 4,464,124 | 8/1984 | Romero et al. . | |
| 4,637,799 | 1/1987 | Bouchal . | |
| 4,651,613 | 3/1987 | Harrison . | |
| 4,690,645 | 9/1987 | Ukisu . | |
| 4,819,539 | 4/1989 | Searing . | |
| 4,836,075 | 6/1989 | Armstrong . | |
| 4,854,879 | 8/1989 | Chang . | |
| 4,884,817 | 12/1989 | Johnson . | |
| 4,889,027 | 12/1989 | Yokoi . | |
| 4,936,185 | 6/1990 | Yamaguchi et al. . | |
| 4,950,165 | 8/1990 | Machaalani . | |
| 4,980,919 | 12/1990 | Tsai . | |
| 5,031,917 | 7/1991 | Greene . | |
| 5,122,952 | 6/1992 | Minkus . | |
| 5,127,869 | 7/1992 | Hanzawa . | |
| 5,188,533 | 2/1993 | Wood . | |
| 5,193,813 * | 3/1993 | Goff | 273/241 |
| 5,249,805 | 10/1993 | Neil et al. . | |
| 5,277,419 | 1/1994 | Craig . | |
| 5,338,040 | 8/1994 | Cutler . | |
| 5,358,252 | 10/1994 | McPhaul . | |
| 5,368,308 | 11/1994 | Darnell . | |

(List continued on next page.)

*Primary Examiner*—Steven Wong
*Assistant Examiner*—D Collins
(74) *Attorney, Agent, or Firm*—Whiteford, Taylor & Preston L.L.P.; Gregory M. Stone, Esq.

(57) ABSTRACT

Disclosed is a three dimensional board game comprised of multiple parallel horizontal levels aligned one atop the other, each level comprising a "grid" of play areas. The game is played with a number of color coded game pieces, each color being associated with a single player, and a plurality of game pieces having a different color from all player's game pieces designated as "neutral" game pieces. The game begins with each one of a player's game pieces positioned in a single play area aligned along a vertical plane of the game board structure. In a two player gaming scenario, each player's game pieces are set up on the game board intermingled with neutral game pieces on two opposing ends of the game board structure. For gaming scenarios comprising more than two players, each player's game pieces are set up along an outer vertical plane of the game board structure without neutral game pieces. The player's game pieces and the neutral game pieces are assigned particular three dimensional movements involving multiple horizontal levels, and players may choose among those movements as they see fit during game play. Certain movements of a player's game piece in a path that intersects or passes over another player's game piece allows the moving player to remove the other player's game piece. The game is won when one player has used the allowed game piece movements to eliminate all opposing players' game pieces from the game board structure.

23 Claims, 9 Drawing Sheets

U.S. PATENT DOCUMENTS

| | | | | |
|---|---|---|---|---|
| 5,409,234 | * | 4/1995 | Bechter | 273/241 |
| 5,429,513 | | 7/1995 | Diaz-Plaza . | |
| 5,478,268 | | 12/1995 | Au . | |
| 5,511,980 | | 4/1996 | Wood . | |
| 5,556,099 | | 9/1996 | Mardirosian . | |
| 5,569,867 | | 10/1996 | Levine . | |
| 5,571,020 | | 11/1996 | Troudet . | |
| 5,595,489 | | 1/1997 | Kwon . | |
| 5,632,375 | | 5/1997 | Mattikow . | |
| 5,655,918 | | 8/1997 | Soh . | |
| 5,660,388 | | 8/1997 | Benn . | |
| 5,662,329 | | 9/1997 | Nason . | |
| 5,678,819 | * | 10/1997 | Underwood | 273/241 |

* cited by examiner

4

| | 1 | 2 | 3 | 4 |
|---|---|---|---|---|
| A | 4A1 | 4A2 | 4A3 | 4A4 |
| B | 4B1 | 4B2 | 4B3 | 4B4 |
| C | 4C1 | 4C2 | 4C3 | 4C4 |
| D | 4D1 | 4D2 | 4D3 | 4D4 |

3

| | 1 | 2 | 3 | 4 |
|---|---|---|---|---|
| A | 3A1 | 3A2 | 3A3 | 3A4 |
| B | 3B1 | 3B2 | 3B3 | 3B4 |
| C | 3C1 | 3C2 | 3C3 | 3C4 |
| D | 3D1 | 3D2 | 3D3 | 3D4 |

2

| | 1 | 2 | 3 | 4 |
|---|---|---|---|---|
| A | 2A1 | 2A2 | 2A3 | 2A4 |
| B | 2B1 | 2B2 | 2B3 | 2B4 |
| C | 2C1 | 2C2 | 2C3 | 2C4 |
| D | 2D1 | 2D2 | 2D3 | 2D4 |

1

| | 1 | 2 | 3 | 4 |
|---|---|---|---|---|
| A | 1A1 | 1A2 | 1A3 | 1A4 |
| B | 1B1 | 1B2 | 1B3 | 1B4 |
| C | 1C1 | 1C2 | 1C3 | 1C4 |
| D | 1D1 | 1D2 | 1D3 | 1D4 |

FIG. 2

THREE DIMENSIONAL BOARD GAME

BACKGROUND OF THE INVENTION

1. Field of the Invention

This invention relates to board games and, more particularly, to a three dimensional board game having a plurality of game pieces comprising indicia to associate a set of game pieces as either belonging to a single game player or as belonging to no game player, and a series of predefined movements associated with each game piece for allowing three dimensional movement of the game pieces on the multiple horizontal levels of the three dimensional game board structure.

2. Description of the Background

Board games have been a measure of entertainment and challenge for centuries. From the origins of the popular game of chess circa 500–700 A.D. to the present, players have often sought to devise new, more interesting, and more challenging ways of modifying board games to provide for a more stimulating gaming experience.

Many players have sought to develop three dimensional board games in an attempt to expand the gaming experience and the player's analysis of gaming moves into multi-planar geometries. While efforts to develop such three dimensional gaming have proceeded, the resulting products are often embodied in games having highly complex rules, multiple game pieces, and complicated structures which so complicate the game process that any added entertainment value is outweighed by the added difficulty in attempting to carry out a gaming session. Thus, the prior art has been unable to address the need for a multi-player, three dimensional game that appropriately balances the need for increased intellectual stimulation and the ability to develop a player's skills of three dimensional spatial analysis, against the need to maintain the enjoyment and leisure intended in playing a recreational game.

For example, U.S. Pat. No. 3,684,285 to Kane discloses a four level chess game configured for play by two opponents, each of which uses a set of eight pawns, two rooks, two knights, two bishops, one queen, and one king, with four of the pawns of each set being marked to distinguish them from other pawns. The allowable movements of each of the chess pieces closely approximate the moves of the same pieces in a traditional chess game.

Likewise, U.S. Pat. No. 4,082,283 to La Ferla et al. discloses a multilevel game board comprising five triangular-shaped horizontal boards of varying sizes. The game rules provide for the movement of game pieces (belonging to each of two players) in straight line movements, allowing the "capture" (or removal from game play) of opposing pieces by "jumping" over the opposing player's game piece in a single move. To accomplish such a "capture," the opposing player's piece must lie in a playing position immediately adjacent to the moving player's game piece, with an open space on the other side of the opposing player's game piece.

Further, U.S. Pat. No. 4,884,817 to Johnson discloses a three-dimensional game board comprising three vertically spaced planes, each of which are divided into thirteen squares. The game rules provide for the "non-capturing" movement of game pieces to adjacent horizontal squares in the same horizontal plane, and to adjacent (non-diagonal) squares in the immediately adjacent vertical plane. The game rules also provide for "capturing" movement, whereby a moving player may capture an opposing player's game piece by jumping over that piece from an adjoining space and landing in a vacant space on the opposite side of the captured piece, and then moving to an adjoining vacant space.

Still further, U.S. Pat. No. 5,031,917 to Greene discloses a three-dimensional chess game comprising eight game boards arranged in vertical relation to one another. Each player is provided a standard set of chess game pieces, along with an additional set of eight pawn pieces. Players take turns as in traditional chess moving their pieces across the game board surface, with movements being limited to a single horizontal or vertical move in any turn, such that in any one move a piece cannot be moved both up or down and fore or aft.

U.S. Pat. No. 5,249,805 to Neil et al. discloses a three-dimensional game comprising multiple tiered levels, each level defining a grid. The game also comprises an electronic number generator which generates numbers which in turn relate to particular grid positions on the game board surface. The game rules provide for awarding points to players who configure their game pieces in particular predefined configurations, and for "disrupting" any player's configuration (i.e., removing one of the moving player's game pieces from the game board) when any part of that configuration falls on a grid position that has been selected by the number generator.

Still further, U.S. Pat. No. 5,277,419 to Craig discloses a three-dimensional board game comprising three or four boards stacked on top of one another with each board divided into a three by three grid of squares. The game is played by two or more players, each player using game pieces identified with that player by color or shape. The goal is for a player to complete the formation of three lines each with three pieces in a line, whether diagonal, vertical, or horizontal. One of each player's pieces is designated a "star" piece, which is the only piece that may be placed in the center square of the intermediate horizontal boards.

Finally, U.S. Pat. No. 5,338,040 to Cutler discloses a three-dimensional chess game played on a four by four by four cubic chessboard by two players, each of whom uses a standard sixteen piece chess set. Each piece is assigned a movement which is a three-dimensional extension analogous to that piece's movement in two-dimensional chess.

Unfortunately, none of the prior art three dimensional games have been able to achieve a three-dimensional board game that may be played by two or more players which achieves an effective balance of the need for increased intellectual stimulation and the ability to develop a player's skills of three dimensional spatial analysis, against the need to maintain the enjoyment and leisure intended in playing a recreational game.

SUMMARY OF THE INVENTION

It is, therefore, an object of the instant invention to provide a three dimensional board game that overcomes the disadvantages of prior art board games.

It is another object of the instant invention to provide a board game that is more interesting, challenging, and fun to play than previously known board games.

It is yet another object of the instant invention to provide a board game that enables multiple three dimensional, multi-planar movements of game pieces through predesignated movement patterns that are achievable by all game pieces on the play surface.

It is even yet another object of the instant invention to provide a board game that simultaneously enables play by 2, 3, or 4 players.

According to the present invention, the above-described and other objects are accomplished by providing a three dimensional board game comprised of a plurality of parallel horizontal levels aligned one atop the other, each level comprising a network of placement areas. In a preferred embodiment of the invention, the network of placement areas on each horizontal level comprises a four by four grid of squares. The game is played with a number of color coded game pieces, each color being associated with a single player, and a plurality of game pieces having a different color from all player's game pieces designated as "neutral" game pieces. The game begins with each one of a player's game pieces positioned in a single square aligned along a vertical plane of the game board structure. In a two player gaming scenario, each player's game pieces are set up on the game board intermingled with neutral game pieces on two opposing ends of the game board structure. For gaming scenarios comprising more than two players, each player's game pieces are set up along an outer vertical plane of the game board structure without neutral game pieces. The player's game pieces and the neutral game pieces are assigned particular three dimensional movements involving multiple horizontal planes, and players may choose among those movements as they see fit during game play. Certain movements of a player's game pieces in a path that intersects or passes over another player's game piece allows the moving player to remove the other player's game piece. The game is won when one player has used the allowed movements to eliminate all opposing players' game pieces from the game board structure.

BRIEF DESCRIPTION OF THE DRAWINGS

Other objects, features, and advantages of the present invention will become more apparent from the following detailed description of the preferred embodiment and certain modifications thereof when taken together with the accompanying drawings in which:

FIG. 2 is an exploded, top down view of the various horizontal game board levels.

DETAILED DESCRIPTION OF THE PREFERRED EMBODIMENTS

Figure 1:
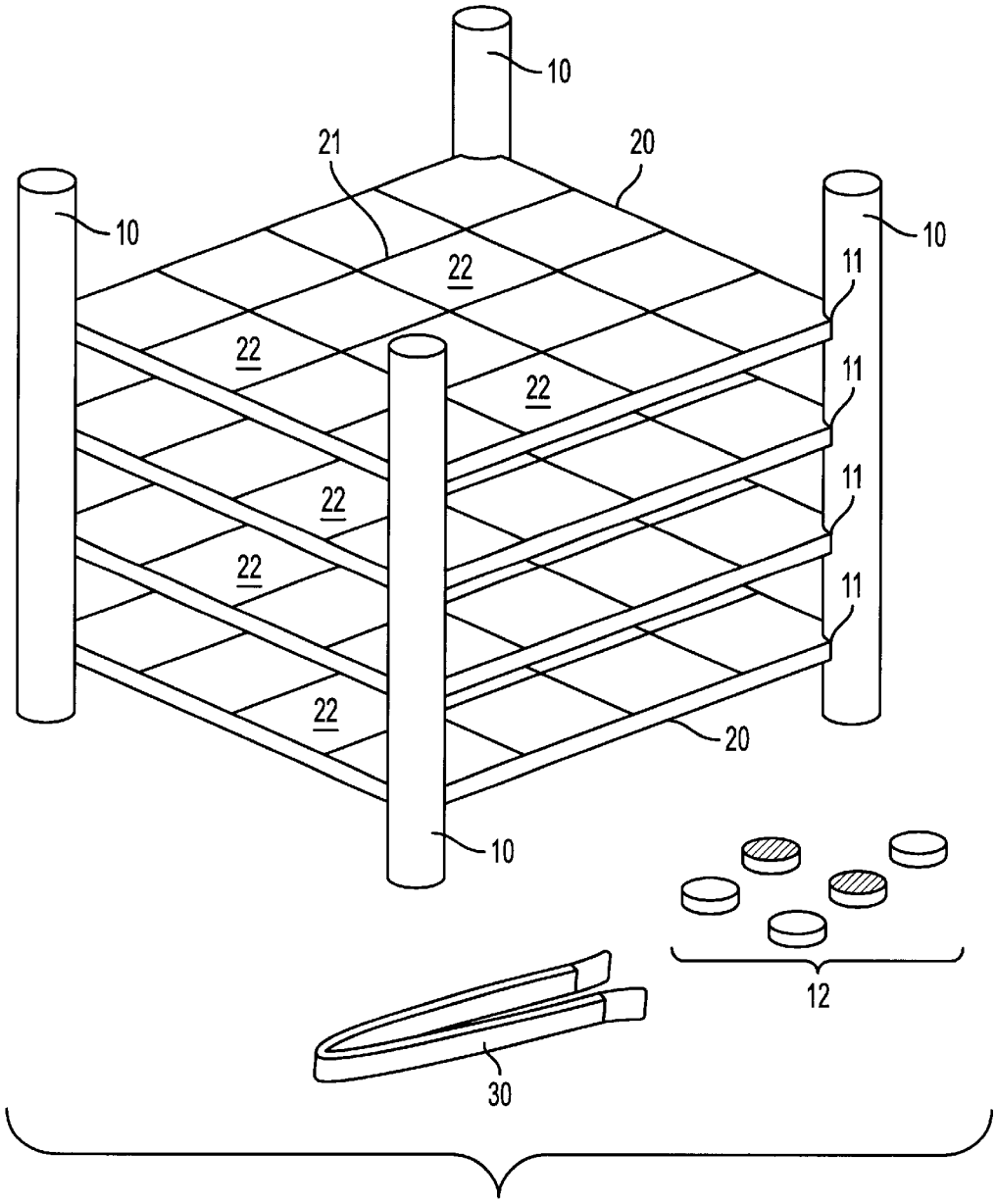
FIG. 1 is a perspective view of the three dimensional game board of the instant invention.

As shown in the perspective view of FIG. 1, the three dimensional game board of the instant invention comprises a plurality of vertical supports 10, each of which is provided with a plurality of notches 11 extending into a sidewall of the vertical support 10. Each notch 11 is configured as a slightly rounded opening which is slightly larger than the width of a horizontal game board level 20, such that a corner of each game board level 20 may be inserted into a notch 11 on vertical support 10. In the fully assembled configuration shown in FIG. 1, a single vertical support is preferably positioned at each corner of a horizontal game board level 20. A single corner of each horizontal game board level engages a single vertical support 10 at a notch 11, such that the four vertical supports support each of the four corners of a single horizontal game board level 20 along a generally horizontal plane. Notches 11 in each vertical support 10 are positioned a sufficient vertical distance from one another, and preferably approximately 3 inches, to ensure easy and ready access to playing chips 12 positioned on any horizontal game board surface 20. Notches 11 may optionally be provided with a flexible gasket (not shown) to securely yet releasably hold each corner of a horizontal game board 20 in place during game play.

Each horizontal game board level 20 is in turn provided with a grid pattern 21, each grid pattern forming a four by four grid of sixteen game piece placement areas (shown in FIG. 1 as individual squares) 22. Thus, the total game play surface is defined by 64 play squares. So that players may readily view the game layout on each horizontal board surface 20 during play, each horizontal board surface 20 is preferably formed from a clear or at least semi-transparent plastic or similarly configured, generally-rigid, see-through material. However, each horizontal game board surface 20 may alternately be colored so as to provide each alternating square with one of two colors so as to allow players to more easily distinguish between "adjacent" squares in alternating horizontal planes.

Likewise, in order to reduce the impact of any glare that may be produced from lighting of the game board surface, and thus the players' view of the surface, a fabric pad or cloth (not shown) may optionally be provided as a base for the entire game board structure, such pad or cloth being dimensioned such that the entire game board structure fits within the area of the pad or cloth. The pad or cloth may likewise be provided with an optimal color and shade that contrasts with the game board surfaces 20 and play pieces 12.

While the most preferred embodiment of the invention as shown in FIG. 1 comprises four horizontal levels, each comprising a four by four grid of squares, it should be noted that the individual placement areas 22 may alternately be designated as any other shape. Likewise, additional horizontal levels as well as additional rows or columns in a single horizontal level may be added to increase the level of challenge and complexity involved in game play, and may likewise be removed to decrease the level of challenge and complexity, without departing from the spirit and scope of the instant invention.

In order to explain the movement of the various game pieces during play, it is necessary to adopt a convention for identifying various locations on the three dimensional game board structure. As shown in the exploded, top-down view of FIG. 2, each of the four horizontal game levels is separated into 16 separate game squares. For purposes of providing a common convention for identifying the game board locations, the uppermost horizontal game board shown in FIG. 1 is labeled "4" on FIG. 2; the next highest game board is labeled "3"; the next highest game board is labeled "2"; and finally, the lowest game board is labeled "1". Each game board also uses the following convention for identifying individual squares: each row is identified by a letter, the top row having the designation "A", the second row having the designation "B", the third row having the designation "C", and the fourth row having the designation "D"; likewise, each column is identified by a numeral, the first column having the designation "1", the second column having the designation "2", the third column having the designation "3", and the fourth column having the designation "4". Given this labeling convention, each individual square on the three dimensional game board may be identified by its board number-row-column designation. For example, the designation "4C2" indicates the square on the third row, second column of top game board 4. Likewise, the designation "1D4" indicates the square on the fourth row, fourth column of bottom game board 1.

Given this configuration, any movement that is said to be within a single horizontal plane means a movement from a first square $Z_iX_1Y_1$ to a second square $Z_iX_2Y_2$, where $Z_i$ is a single horizontal game board, $X_1$ and $X_2$ are first and second column numbers, respectively, within horizontal game board i, and $Y_1$ and $Y_2$ are first and second row numbers, respectively, within horizontal game board i. Likewise, any movement that is said to be within a single vertical row means a movement from a first square $Z_1X_iY_1$ to a second square $Z_2X_iY_2$, or alternately from a first square $ZX_1Y_i$ to a second square $Z_2X_2Y_i$, where $X_i$ is a single column number extending vertically through each horizontal game board, and $Y_i$ is a single row number extending vertically through each horizontal game board.

The game is played using a plurality of play pieces 12 (FIG. 1) preferably configured as a disk (similar to a traditional checkers play piece), and sized such that a single play piece may occupy any open play square 22 on the three dimensional game board surface. A total of 48 game pieces are provided, the 48 separate pieces being separated into 5 groupings all having a common color or indicia. Preferably, there are 12 pieces of a first color, 12 pieces of a second color, 8 pieces of a third color, 8 pieces of a fourth color, and 8 pieces of a fifth color. The 8 pieces of the fifth color are designated as "neutral" game pieces, while each of the other pieces are designated as "player" pieces.

In a first embodiment of the method of the instant invention involving two person game play, and as explained in greater detail below, the 12 pieces of a first color and 12 pieces of a second color are used by each of two respective game players, and the 8 neutral pieces are interspersed with the player's pieces. In a second embodiment of the method of the instant invention involving more than two person game play, 8 pieces of the first color, 8 pieces of the second color, 8 pieces of the third color, and optionally 8 pieces of the fourth color are used by each of three or four respective game players, and the 8 neutral pieces are not initially used. The remaining 4 pieces of the first and second colors are not used for game play of more than two players.

For ease of manipulation of the game pieces during play, tongs 30 (FIG. 1) are provided which a player may use for reaching between adjacent horizontal game board levels to execute movements of the game pieces. The tongs are of relatively conventional design, and may be formed of metal, plastic, or any similarly configured, generally flexible material.

The object of the game of the instant invention is for a player to move his or her game pieces, or a neutral game piece, through selected, rule-sanctioned movement patterns to capture all of an opponent's pieces and thus remove them from the game, while avoiding capture of that player's own game pieces. Players take turns moving a single game piece during each game turn. Certain moves, as described in detail below, allow a player's game piece to, at the player's option, "capture" or remove from the game board surface an opponent's game piece that lies in the path of travel of the moving player's game piece. Other moves allow a player's game piece to "bump" an opponent's game piece that lies in the square where the moving player's movement is terminated, thus moving the opponent's game piece from one play square to an adjacent play square. Such a move may be desirable because certain game piece patterns on a single horizontal game board surface enable a moving player to capture every one of an opponent's game pieces on that horizontal game board surface during a single turn.

When one player has successfully removed each of the remaining players' game pieces from the game board surface, that player is deemed the winner and play is terminated. However, in the event that one player finds themselves with only a single game piece remaining on the game board surface, a game turn countdown ensues. If the player with a single game piece remaining completes her next six turns, and the opposing player's subsequent move is unable to capture the first player's remaining game piece, the game play terminates in a "draw" or "tie."

For purposes of playing with either three or four players, game play ensues as described above, each player taking turn sand moving their game pieces in an attempt to remove each of the other players' game pieces from the game board surface. For three or four player game play, if a single player has only one game piece remaining, and successfully completes her next four turns without having that single game piece captured by any other player, then such player may return a single one of their previously captured game pieces to the game board surface at any open play square location. When only two players remain, each of the two players take turns placing each of the eight neutral chips on the game board surface in any open play square location. If, after placing their entire share of neutral game pieces, a player has only a single game piece left on the game board surface, then such player may place one of their previously captured chips on any open square of the game board surface. Game play thereafter continues as with the two player game scenario until either a single player's game pieces remain on the game surface or a draw is declared.

The specific movements of the game pieces will now be described with reference to FIGS. 3–8.

Figure 3A:
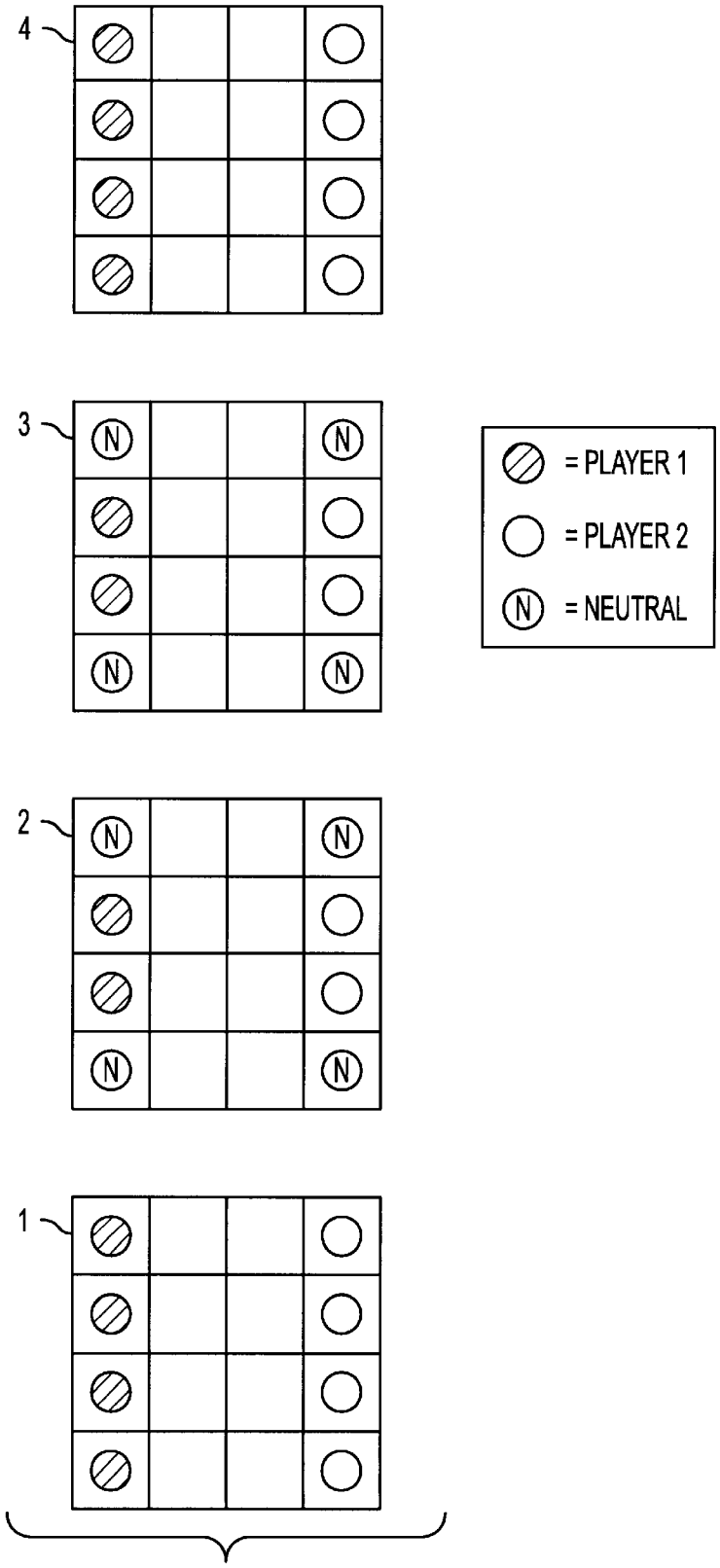
FIG. 3*a* is an exploded, top down view of the game board levels at the start of two person play.
Figure 3B:
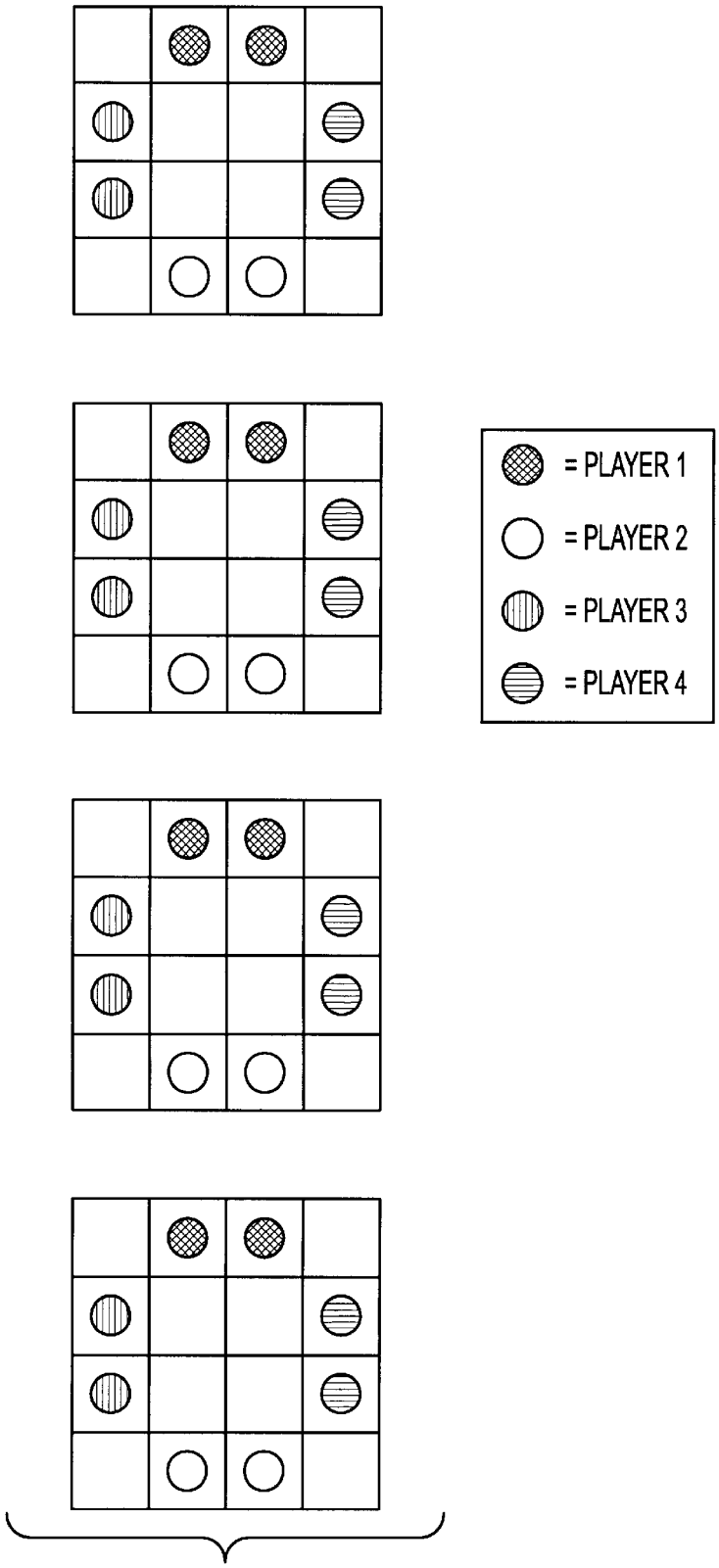
FIG. 3*b* is an exploded, top down view of the game board levels at the start of four person play.

As shown in FIG. 3*a,* at the start of a two player game, each player deposits their 12 game pieces on the game board surface as follows. Each player places four pieces on opposing end columns of levels 1 and 4. Each player likewise places two pieces on opposing end columns of levels 2 and 3 at rows B and C. Neutral game pieces are then placed in each corner game square of levels 2 and 3. Likewise, as shown in FIG. 3*b,* at the start of a four player game, each player places two pieces on adjacent squares between two corners of each horizontal play surface such that each player's pieces are vertically aligned in two adjacent vertical columns extending through each of the four horizontal play surfaces.

Figure 4:
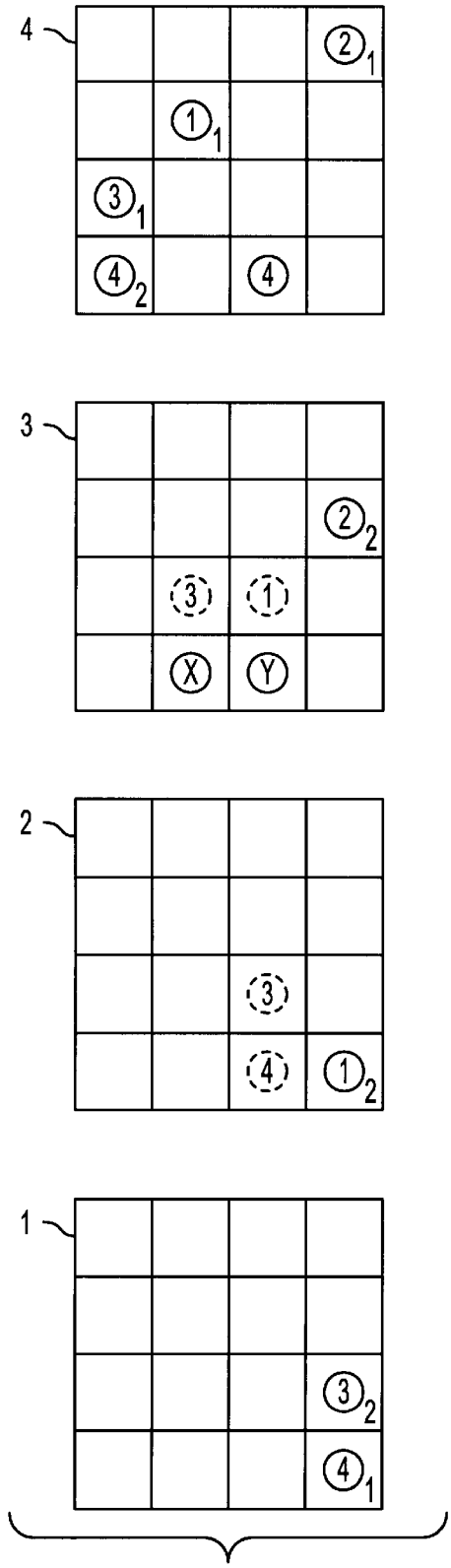
FIG. 4 is an exploded, top down view of the three dimensional game board depicting "linear" moves across the game board surface.

FIG. 4 depicts the function of "linear" movement of a game piece, and "capture" executed through a linear movement. Linear movement is defined as movement of a single game piece from a starting position to an ending position through a continuous, straight line of adjacent game squares, whether such adjacent game squares are within a single horizontal plane or adjacent horizontal planes. Linear movement of a player's game piece subjects any game piece lying in the path of travel of the game piece from its starting position to its ending position to be subject to capture by the moving player (at the moving player's discretion).

A player selecting to move her game piece in a linear move may move the piece in any direction, to any plane, and any number of spaces, so long as that movement proceeds through a continuous, straight line which intersects the midpoint of a game piece placement area 22 on each horizontal level through which it travels. Thus, as shown in FIG. 4, game piece 1 which at the start of a player's turn rests at location 4B2 on level 4, may (at the option of the player) be moved to play square 2D4 on level 2 and have such move be considered a linear move, because the imaginary line running between the first and last positions of game piece 1 intersects the midpoint of a play square at every intermediate horizontal level, namely, play square 3C3 on level 3 (as shown in phantom on level 3). Likewise, game piece 2 which at the start of the player's turn rests at location 4A4, may be moved to location 3B4 on level 3 in a linear move. Similarly, game piece 3 which at the start of the player's turn rests at location 4C1, may be moved to location 1D4 on level 1 in a linear move.

It should be noted that in a single turn, a player moves only a single game piece. The description of multiple game piece movements above (and below) is for purposes of describing the general characteristics of linear movements and by way of example only, and not intended to depict the movement of several game pieces in a single turn.

To exemplify the process of using a linear move to capture an opponent's game piece, FIG. 4 depicts a game piece 4 belonging to a first player and initially positioned on level 1 at location 1D4, and two game pieces X and Y belonging to a second player on level 3 at locations 3D2 and 3D3, respectively. In executing a linear move, the first player may move its game piece 4 from location 1D4 to location 4D1 so that its path of travel intersects game piece X. The first player may then elect to capture the second player's game piece X and remove it from the game board structure. However, as the path of travel did not intersect game piece Y, the second player's game piece Y remains in play on the game board.

Figure 5:
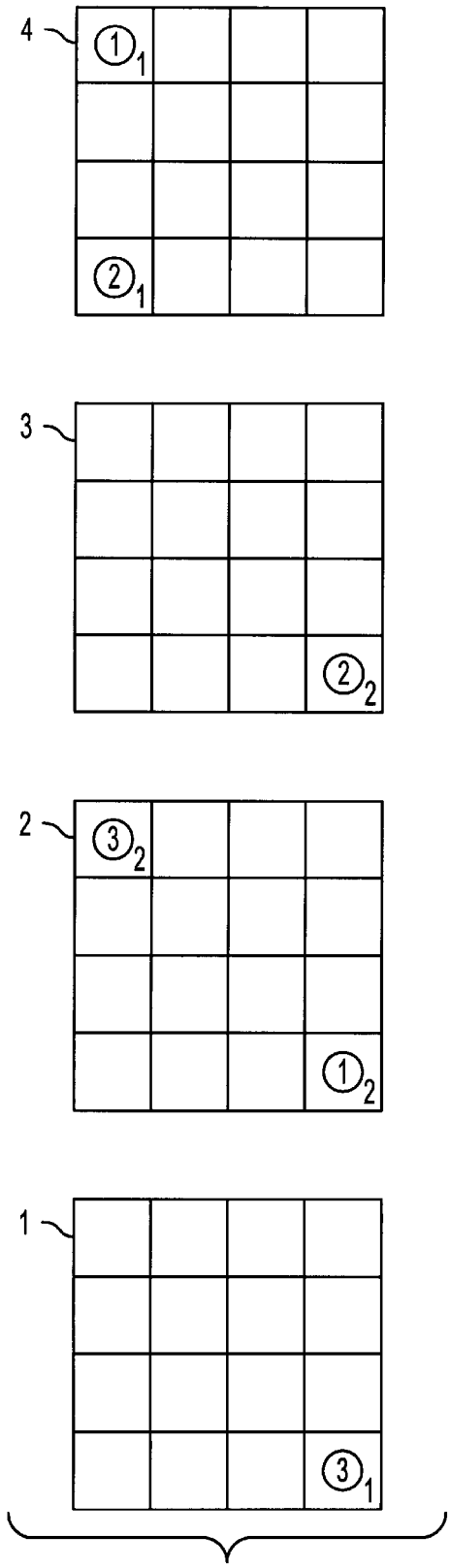
FIG. 5 is an exploded, top down view of the three dimensional game board depicting "corner" moves across the game board surface.

Next, FIG. 5 depicts the function of a "corner" movement. Corner movement is defined as the movement of a game piece from a first corner of any horizontal game board surface to a second, open corner of a horizontal game board surface on any horizontal plane and through any number of intermediate squares. Thus, as shown in FIG. 5, game piece 1 which at the start of a player's turn rests at location 4A1 on level 4, may (at the option of the player) be moved to, for example, play square 2D4 on level 2, with such move being considered a corner move. Likewise, game piece 2 which at the start of the player's turn rests at location 4D1, may be moved to location 3D4 on level 3 in a corner move. Similarly, game piece 3 which at the start of the player's turn rests at location 1D4, may be moved to location 2A1 on level 2 in a corner move.

A corner move does not allow the moving player the option to capture an opposing player's game piece unless such corner move also happens to be a linear move, and the game piece to be captured lies within the path of travel of that linear move.

Figure 6:
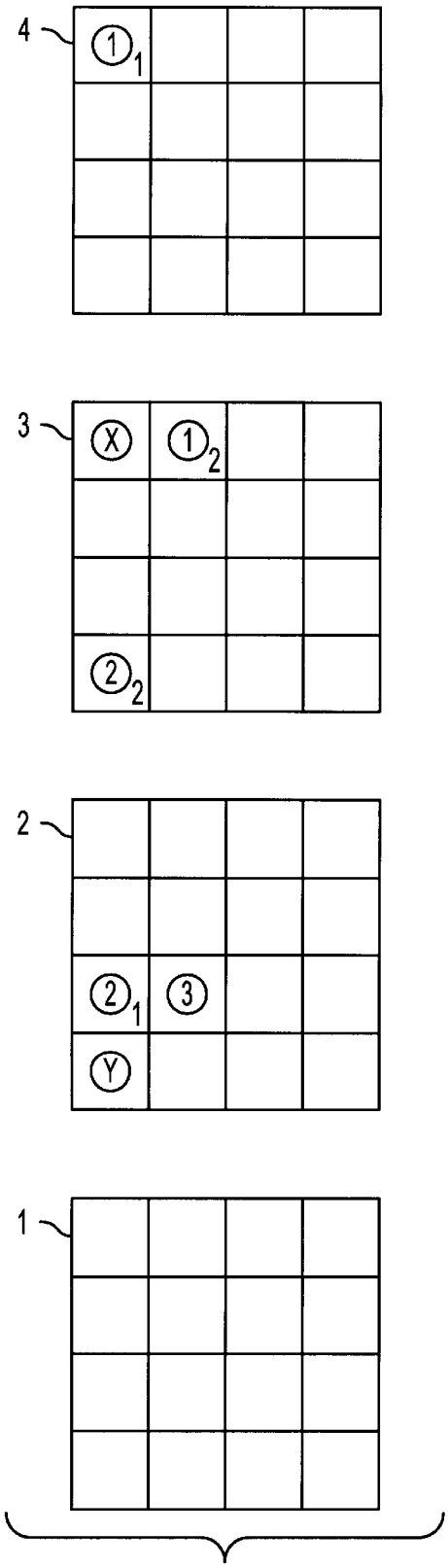
FIG. 6 is an exploded, top down view of the three dimensional game board depicting "angular" moves across the game board surface.

Next, FIG. 6 depicts the function of the "angular" movement. Two types of movements define an angular movement. The first is depicted by the movement of a game piece from a corner of any horizontal level, through an adjacent corner on a second, adjacent horizontal level, and to a play square immediately to the top, bottom, left, or right of the second corner play square. The second is depicted by the movement of a game piece from a play square immediately to the top, bottom, left, or right of any corner play square, through the adjacent corner play square on the same horizontal level, and to an adjacent corner on a second, adjacent horizontal level. Angular movement of a player's game piece subjects any game piece lying in the intermediate corner to capture by the moving player (at the moving player's discretion). Thus, as shown in FIG. 6, game piece 1 which at the start of a player's turn rests at location 4A1 on level 4, may (at the option of the player) be moved to play square 3A2 on level 3 and have such move be considered an angular move, in turn subjecting an opposing player's game piece X to capture at the option of the moving player. Likewise, game piece 2 which at the start of the player's turn rests at location 2C1, may be moved to corner location 3D1 on level 3 in an angular move, in turn subjecting an opposing player's game piece Y to capture at the option of the moving player. However, game piece 3 which at the start of the player's turn rests at location 2C2, may not be used to execute an angular move, and thus capture the opponent's game piece Y, because it does not lie in a play square immediately to the top, bottom, left, or right of the intermediate corner play square.

Figure 7:
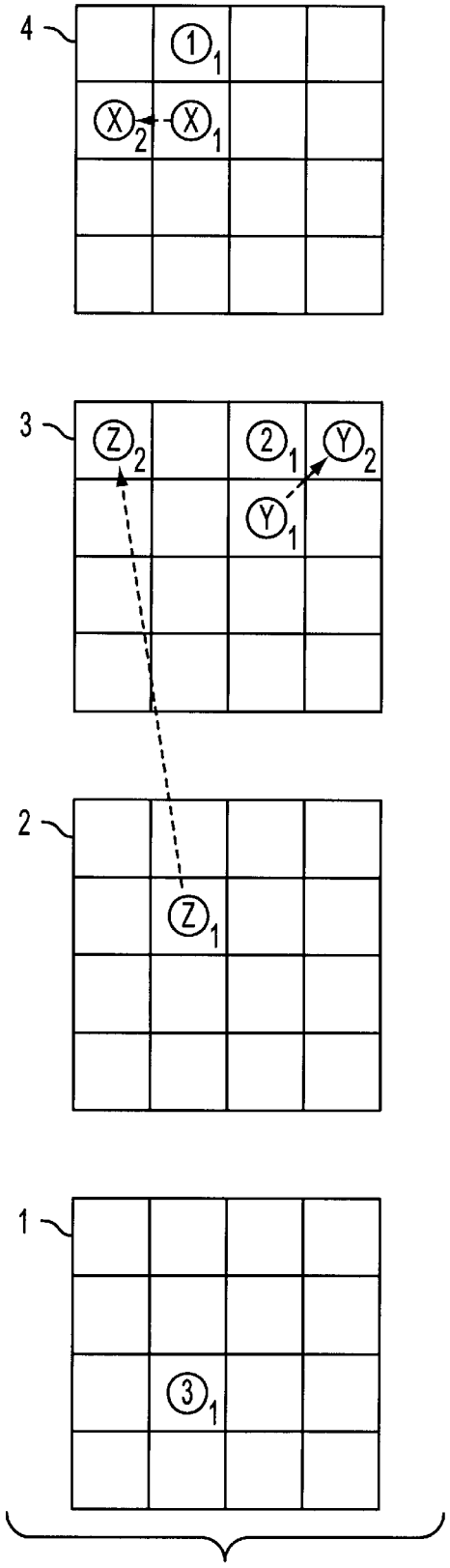
FIG. 7 is an exploded, top down view of the three dimensional game board depicting "bump" moves across the game board surface.

Next, FIG. 7 depicts the function of the "bump" movement. The bump movement is defined as the movement of a game piece from any play square to a second, adjacent play square in any direction and on either the same plane or an adjacent horizontal plane, where the second, adjacent play square occupies game piece other than the moving player's game piece (including neutral game pieces). The moving player then moves the "bumped" game piece to any adjacent play square in any direction and on either the same plane or an adjacent horizontal plane, including the space now emptied and at the start of the turn occupied by the moving player's game piece. Thus, as shown in FIG. 7, game piece 1 which at the start of a player's turn rests at location 4A2 on level 4, may (at the option of the player) be moved to play square 4B2 on level 4 which in turn occupies another player's game piece X (or a neutral game piece X). As part of the same turn, the moving player in turn moves the "bumped" game piece X to any adjacent location, such as to location 4B1 on level 4. Likewise, game piece 2 which at the start of the player's turn rests at location 3A3, may be moved to play square 3B3 which in turn occupies another player's game piece Y. Again, as part of the same turn, the moving player in turn moves the "bumped" game piece Y to, for example, play square 3A4.

The bump movement may also be accomplished through multiple horizontal levels, as shown by the movement of game piece 3. Game piece 3, which at the start of the player's turn rests at location 1C2 on level 1, may be moved to play square 2B2 on level 2 which in turn occupies another player's game piece Z. As part of the same turn, the moving player in turn moves the "bumped" game piece Z to, for example, play square 3A1 on level 3.

Figure 8:
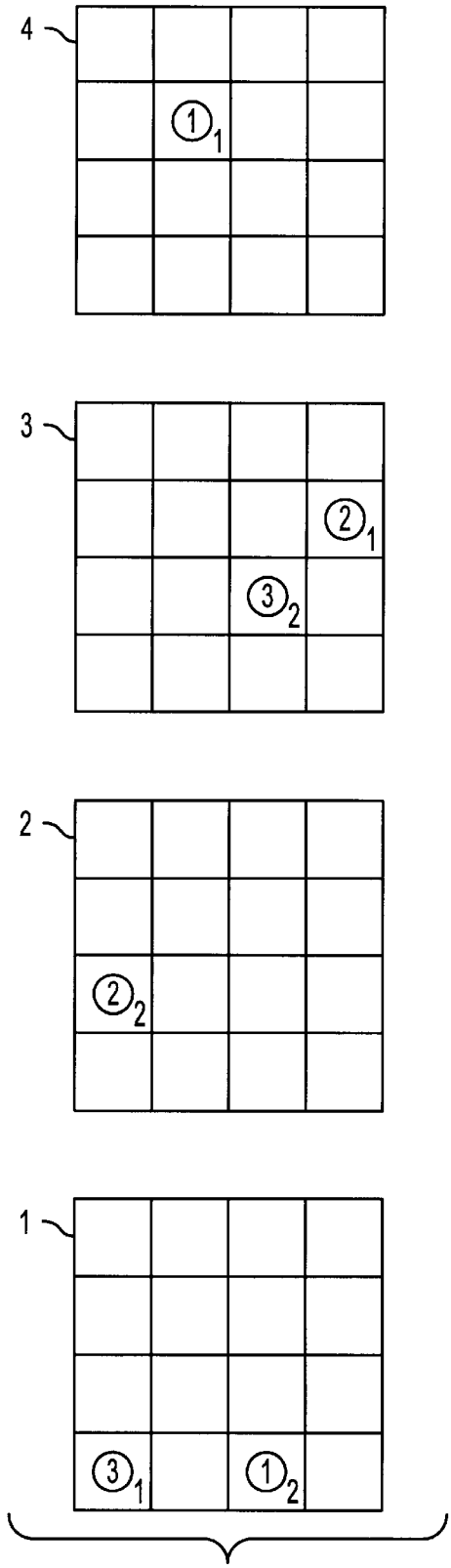
FIG. 8 is an exploded, top down view of the three dimensional game board depicting "nonlinear" moves across the game board surface.

FIG. 8 depicts the function of a "nonlinear" movement. Nonlinear movement is defined as the movement of a game piece from one play square to another play square, in any direction, to any horizontal plane, and through any number of intermediate squares, which does not fit any other movement definition (i.e., linear, corner, angular, or bump). A nonlinear movement allows a player to move her game piece to any other open location on the game board surface, but does not allow the moving player to either capture or bump any opposing player's game pieces that might fall within the path of travel of the moving player's game piece. Thus, as shown in FIG. 8, game piece 1 which at the start of a player's turn rests at location 4B2 on level 4, may (at the option of the player) be moved to, for example, play square 1D3 on level 1, with such move being considered a nonlinear move. Likewise, game piece 2 which at the start of the player's turn rests at location 3B4, may be moved to location 2C1 on level 2 in a nonlinear move. Similarly, game piece 3 which at the start of the player's turn rests at location 1D1, may be moved to location 3C3 on level 3 in a nonlinear move.

A significant feature of the instant invention exists in the ability of a number of a single player's game pieces to assume a particular configuration on a single horizontal level which in turn allows the moving player to capture all opposing player's game pieces on that same horizontal level. The first such configuration is known as an "inner" configuration, and the second such configuration is known as a "cross" configuration.

In order to achieve an inner configuration, a moving player must position four of her chips on each of the four center play squares on any single horizontal level. Thus, referring again to FIG. 2, a player may position four of his pieces on level 4 at locations 4B2, 4B3, 4C2, and 4C3 to achieve the inner configuration. In the event that a moving player completes her move to result in an inner configuration, every opposing player's game piece that is present on the horizontal level in which the inner configuration is achieved may, at the option of the moving player, be captured and removed from the playing surface.

Likewise, in order to achieve a cross configuration, a moving player must position four of her game pieces on each of the four corner play squares on any horizontal level. Thus, a player may position four of his pieces on level 4 at locations 4A1, 4D1, 4A4, and 4D4 to achieve the cross configuration. In the event that a moving player completes her move to result in a cross configuration, every opposing player's game piece that is present on the horizontal plane in which the cross configuration is achieved may, at the option of the moving player, be captured and removed from the playing surface.

Each of the above-defined moves may be exercised by a player by either moving her own play chip or by moving a neutral play chip. However, neutral game chips are never subject to capture by any player, may only be used to capture an opposing player's game chip by moving the neutral chip in a linear or angular movement, and may not be used to bump an opposing player's game chip (although the neutral chips themselves are subject to bumping from opposing player's chips). Moreover, it is important to note that when a player achieves a move or play piece configuration that can be classified as more than one type of move or configuration (e.g., a single player simultaneously being able to claim both "cross" and "inner" configurations), such player must select only a single classification for that move, and thus have open only those play options that are associated with that single classification. Thus, by way of example, if at any time a single player simultaneously achieves both "cross" and "inner" configurations on multiple levels, such a player must select a single one of those levels on which she will exercise either the "cross" or "inner" move options.

While the above explanation of the instant invention describes a physical three dimensional game board structure, it should also be noted that the method of the instant invention may likewise be practiced on a computer software model of the above-described three dimensional game board, with restrictions on movements as defined above of individual game pieces across the virtual, computer-generated three dimensional game board structure. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. For example, game pieces 12 may assume a cubical, pyramidal, or other three dimensional shape, and tongs 30 may be configured in any form which allows manipulation of the game pieces across the game board surface. Likewise, more or fewer game levels 20 may be provided to alter the complexity of the game. It should be understood, therefore, that the invention may be practiced otherwise than as specifically set forth herein.

What is claimed is:

1. A method of playing a three dimensional board game comprising the steps of:

(a) providing a three dimensional game board comprising a plurality of horizontal levels, each of said horizontal levels further comprising a plurality of game piece placement areas, and each of said horizontal levels being defined as having a front edge, a rear edge, a left edge, and a right edge, and a corner at the intersection of each adjacent edge;

(b) providing a plurality of player sets of player game pieces arranged on said game board, each of said player sets of player game pieces bearing indicia to identify each said player game piece with a single one of said player sets, said number of player sets equating to a number of players of said board game;

(c) providing a neutral set of neutral game pieces arranged on said game board bearing indicia to identify each said neutral game piece with said neutral set;

(d) defining the movement of said player game pieces as having five modes, a linear mode, a corner mode, an angular mode, a nonlinear mode, and a bump mode, and defining the movement of said neutral game pieces as having four modes, a linear mode, a corner mode, an angular mode, and a nonlinear mode;

(e) allowing a moving player to move one of a player game piece and a neutral game piece through one of said modes from a first position to a second position; and (f) allowing a moving player to remove from said game board another player's game piece when said moving player moves a game piece through either of said linear mode and said angular mode, and said another player's game piece lies within an imaginary path of travel of said moving player's game piece from said first position to said second position;

said bump mode being defined as movement of one of a player game piece and a neutral game piece from a first placement area in any direction to a second placement area adjacent said first placement area and holding an opposing player game piece.

2. The method of playing a three dimensional board game of claim 1, said linear mode being defined as movement of one of a player game piece and a neutral game piece from a first placement area to a second placement area that does not occupy any other game piece, in any direction, to any horizontal level, and through any number of intermediate placement area on said game board, wherein the movement from said first placement area to said second placement area defines an imaginary line which intersects a midpoint of said first placement area, said second placement area, and any intermediate placement areas.

3. The method of playing a three dimensional board game of claim 1, said corner mode being defined as movement of one of a player game piece and a neutral game piece from a first placement area located at a corner of one of said horizontal levels to a second placement area located a corner of any of said horizontal levels which does not occupy any other game piece.

4. The method of playing a three dimensional board game of claim 1, said angular mode being defined as one of:

movement of one of a player game piece and a neutral game piece from a first placement area located at a corner of one of said horizontal levels, through an adjacent second corner on an adjacent horizontal level and holding an opposing player game piece, and then to any placement area immediately to the top, bottom, left, or right of said second corner; and movement of one of a player game piece and a neutral game piece from a first placement area located immediately to the top, bottom, left or right of a corner of one of said horizontal levels, through an adjacent placement area located at said corner of said horizontal level and holding an opposing player game piece, and then to a placement area located at an adjacent corner of an adjacent horizontal level.

5. The method of playing a three dimensional board game of claim 1, said nonlinear mode being defined as movement of a player game piece from a first placement area to any other placement area on the game board which does not hold an opposing player game piece.

6. The method of playing a three dimensional board game of claim 1, further comprising the step of:

(g) allowing a moving player to remove all opposing player game pieces from a single horizontal level when said moving player simultaneously occupies all placement areas on a single horizontal level that do not coincide with said corner, said front edge, said rear edge, said left edge, and said right edge of said single horizontal level.

7. The method of playing a three dimensional board game of claim 1, further comprising the step of:

(h) allowing a moving player to remove all opposing player game pieces from a single horizontal level when said moving player simultaneously occupies all four corner placement areas on said single horizontal level.

8. The method of playing a three dimensional board game of claim 1, wherein said number of player sets of player game pieces comprise a first set of 12 player game pieces having a first color, a second set of 12 player game pieces having a second color, a third set of 8 player game pieces having a third color, and a fourth set of 8 player game pieces having a fourth color, and said neutral set of neutral game pieces comprise a fifth set of 8 neutral game pieces having a fifth color.

9. The method of playing a three dimensional board game of claim 1, prior to step (e), further comprising the steps of:

(i) designating 12 game pieces of a first color as a first player's game pieces;

placing 4 of said first player's game pieces along a left edge of a top horizontal level;

placing 4 of said first player's game pieces along a left edge of a bottom horizontal level;

placing 2 of said first player's game pieces along a left edge of a horizontal level immediately below said top horizontal level, not including any corner placement areas; and placing 2 of said first player's game pieces along a left edge of a horizontal level immediately above said bottom horizontal level, not including any corner placement areas;

(ii) designating 12 game pieces of a second color as a second player's game pieces;

placing 4 of said second player's game pieces along a right edge of a top horizontal level;

placing 4 of said second player's game pieces along a right edge of a bottom horizontal level;

placing 2 of said second player's game pieces along a right edge of a horizontal level immediately below said top horizontal level, not including any corner placement areas; and placing 2 of said second player's game pieces along a right edge of a horizontal level immediately above said bottom horizontal level, not including any corner placement areas; and (iii) designating 8 pieces of a third color as neutral game pieces, and placing one of said neutral game pieces on each corner game piece placement area on each of said horizontal level immediately below the top horizontal level, and said horizontal level immediately above the bottom horizontal level.

10. The method of playing a three dimensional board game of claim 1, prior to step (e), further comprising the steps of:

(i) designating 8 game pieces of a first color as a first player's game pieces, and placing 2 of said first player's game pieces along a top edge of each said horizontal level, not including any corner placement areas;

(ii) designating 8 game pieces of a second color as a second player's game pieces, and placing 2 of said second player's game pieces along a bottom edge of each said horizontal level, not including any corner placement areas;

(iii) designating 8 game pieces of a third color as a third player's game pieces, and placing 2 of said third player's game pieces along a left edge of each said horizontal level, not including any corner placement areas; and (iv) designating 8 game pieces of a fourth color as a fourth player's game pieces, and placing 2 of said fourth player's game pieces along a right edge of each said horizontal level, not including any corner placement areas.

11. A method of playing a three dimensional board game comprising the steps of:

(a) providing a three dimensional game board comprising a plurality of horizontal levels, each of said horizontal levels further comprising a plurality of game piece placement areas, and each of said horizontal levels being defined as having a front edge, a rear edge, a left edge, and a right edge, and a corner at an intersection of each adjacent edge;

(b) providing a plurality of player sets of player game pieces arranged on said game board, each of said player game pieces having a common structure, and each of said player sets of player game pieces bearing indicia to identify each said player game piece with a single one of said player sets, said number of player sets equating to a number of players of said board game;

(c) providing a neutral set of neutral game pieces arranged on said game board bearing indicia to identify each said neutral game piece with said neutral set;

(d) defining the movement of said player game pieces as having five distinct modes, and defining the movement of said neutral game pieces as having four of said five distinct modes;

(e) allowing a moving player to move one of a player game piece and a neutral game piece through one of said modes from a first position to a second position;

(f) allowing a moving player to remove from said game board another player's game piece when said moving player moves a game piece through at least one of said modes, and said another player's game piece lies within an imaginary path of travel of said moving player's game piece from said first position to said second position; and (g) allowing a moving player to remove all opposing player game pieces from a single horizontal level when said moving player simultaneously occupies all four corner placement area on said single horizontal level.

12. The method of playing a three dimensional board game of claim 11, said five distinct modes further comprising a linear mode, a corner mode, an angular mode, a nonlinear mode, and a bump mode.

13. The method of playing a three dimensional board game of claim 12, said movement of said neutral game pieces further comprising said linear mode, said corner mode, said angular mode, and said nonlinear mode.

14. The method of playing a three dimensional board game of claim 11, further comprising the step of:

(h) allowing a moving player to remove opposing player game pieces from a single horizontal level when said moving player simultaneously occupies all placement areas on a single horizontal level that do not coincide with said corner, said front edge, said rear edge, said left edge, and said right edge of said single horizontal level.

15. A method of playing a three dimensional board game comprising the steps of:

(a) providing a three dimensional game board comprising a plurality of horizontal levels, each of said horizontal levels further comprising a plurality of game piece placement areas, and each of said horizontal levels being defined as having a front edge, a rear edge, a left edge, and a right edge, and a corner at the intersection of each adjacent edge;

(b) providing a plurality of player sets of player game pieces arranged on said game board, each of said player sets of player game pieces bearing indicia to identify each said player game piece with a single one of said player sets, said number of player sets equating to a number of players of said board game;

(c) providing a neutral set of neutral game pieces arranged on said game board bearing indicia to identify each said neutral game piece with said neutral set;

(d) defining the movement of said player game pieces as having five modes, a linear mode, a corner mode, an angular mode, a nonlinear mode, and a bump mode, and defining the movement of said neutral game pieces as having four modes, a linear mode, a corner mode, an angular mode, and a nonlinear mode;

(e) allowing a moving player to move one of a player game piece and a neutral game piece through one of said modes from a first position to a second position;

(f) allowing a moving player to remove from said game board another player's game piece when said moving player moves a game piece through either of said linear mode and said angular mode, and said another player's game piece lies within an imaginary path of travel of said moving player's game piece from said first position to said second position; and (g) allowing a moving player to remove all opposing player game pieces from a single horizontal level when said moving player simultaneously occupies all placement areas on a single horizontal level that do not coincide with said corner, said front edge, said rear edge, said left edge, and said right edge of said single horizontal level.

16. The method of playing a three dimensional board game of claim 15, said linear mode being defined as movement of one of a player game piece and a neutral game piece from a first placement area to a second placement area that does not occupy any other game piece, in any direction, to any horizontal level, and through any number of intermediate placement area on said game board, wherein the movement from said first placement area to said second placement area defines an imaginary line which intersects a midpoint of said first placement area, said second placement area, and any intermediate placement areas.

17. The method of playing a three dimensional board game of claim 15, said corner mode being defined as movement of one of a player game piece and a neutral game piece from a first placement area located at a corner of one of said horizontal levels to a second placement area located a corner of any of said horizontal levels which does not occupy any other game piece.

18. The method of playing a three dimensional board game of claim 15, said angular mode being defined as one of:

movement of one of a player game piece and a neutral game piece from a first placement area located at a corner of one of said horizontal levels, through an adjacent second corner on an adjacent horizontal level and holding an opposing player game piece, and then to any placement area immediately to the top, bottom, left, or right of said second corner; and movement of one of a player game piece and a neutral game piece from a first placement area located immediately to the top, bottom, left or right of a corner of one of said horizontal levels, through an adjacent placement area located at said corner of said horizontal level and holding an opposing player game piece, and then to a placement area located at an adjacent corner of an adjacent horizontal level.

19. The method of playing a three dimensional board game of claim 15, said bump mode being defined as movement of one of a player game piece and a neutral game piece from a first placement area in any direction to a second placement area adjacent said first placement area and holding an opposing player game piece.

20. The method of playing a three dimensional board game of claim 15, said nonlinear mode being defined as movement of a player game piece from a first placement area to any other placement area on the game board which does not hold an opposing player game piece.

21. The method of playing a three dimensional board game of claim 15, further comprising the step of:

(h) allowing a moving player to remove opposing player game pieces from a single horizontal level when said moving player simultaneously occupies all four corner placement area on said single horizontal level.

22. The method of playing a three dimensional board game of claim 15, prior to step (e), further comprising the steps of:

(i) designating 12 game pieces of a first color as a first player's game pieces;

placing 4 of said first player's game pieces along a left edge of a top horizontal level;

placing 4 of said first player's game pieces along a left edge of a bottom horizontal level;

placing 2 of said first player's game pieces along a left edge of a horizontal level immediately below said top horizontal level, not including any corner placement areas; and placing 2 of said first player's game pieces along a left edge of a horizontal level immediately above said bottom horizontal level, not including any corner placement areas;

(ii) designating 12 game pieces of a second color as a second player's game pieces;

placing 4 of said second player's game pieces along a right edge of a top horizontal level;

placing 4 of said second player's game pieces along a right edge of a bottom horizontal level;

placing 2 of said second player's game pieces along a right edge of a horizontal level immediately below said top horizontal level, not including any corner placement areas; and placing 2 of said second player's game pieces along a right edge of a horizontal level immediately above said bottom horizontal level, not including any corner placement areas; and (iii) designating 8 pieces of a third color as neutral game pieces, and placing one of said neutral game pieces on each corner game piece placement area on each of said horizontal level immediately below the top horizontal level, and said horizontal level immediately above the bottom horizontal level.

23. The method of playing a three dimensional board game of claim 15, prior to step (e), further comprising the steps of:

(i) designating 8 game pieces of a first color as a first player's game pieces, and placing 2 of said first player's game pieces along a top edge of each said horizontal level, not including any corner placement areas;

(ii) designating 8 game pieces of a second color as a second player's game pieces, and placing 2 of said second player's game pieces along a bottom edge of each said horizontal level, not including any corner placement areas;

(iii) designating 8 game pieces of a third color as a third player's game pieces, and placing 2 of said third player's game pieces along a left edge of each said horizontal level, not including any corner placement areas; and (iv) designating 8 game pieces of a fourth color as a fourth player's game pieces, and placing 2 of said fourth player's game pieces along a right edge of each said horizontal level, not including any corner placement areas.

* * * * *